United States Patent [19]

Hagemeyer et al.

[11] Patent Number: 4,573,287

[45] Date of Patent: Mar. 4, 1986

[54] DOUBLE OPENING EXTERIOR FRENCH DOOR AND DOOR IMPROVEMENTS

[75] Inventors: Bruce A. Hagemeyer, Pella; Mearl J. Minter, Oskalossa, both of Iowa

[73] Assignee: Rolscreen Company, Pella, Iowa

[21] Appl. No.: 572,226

[22] Filed: Jan. 19, 1984

[51] Int. Cl.[4] ..... E06B 3/34

[52] U.S. Cl. ..... 49/381; 49/366; 49/484; 49/501; 49/504

[58] Field of Search ..... 49/484, 501, 504, 505, 49/399, 381, 476, 366

[56] References Cited

U.S. PATENT DOCUMENTS

| | | | |
|---|---|---|---|
| 1,563,409 | 12/1925 | Walker | 49/476 X |
| 2,853,162 | 9/1958 | David et al. | 49/399 X |
| 2,927,353 | 3/1960 | Snitker | 49/399 X |
| 3,032,837 | 5/1962 | Ramsey | 49/505 X |
| 3,491,584 | 1/1970 | Selzer | 49/501 |
| 3,518,794 | 7/1970 | Horner | 49/505 |
| 3,694,961 | 10/1972 | Johnson | 49/504 X |
| 3,815,285 | 6/1974 | Kuyper | 49/504 X |
| 4,012,868 | 3/1977 | Andruszkiewicz | 49/505 X |
| 4,207,707 | 6/1980 | Holdiman et al. | 49/504 X |
| 4,214,405 | 7/1980 | Chupik | 49/504 X |

*Primary Examiner*—Philip C. Kannan

*Attorney, Agent, or Firm*—Zarley, McKee, Thomte, Voorhees & Sease

[57] ABSTRACT

A door assembly is provided and generally includes a door frame having a door hingedly mounted on one of the jambs of the frame. The door includes stiles and rails with double glazing panels mounted between the stiles and rails with an insulating air space between the glazing panels. First and second weatherstripping members cooperate with the door and jambs of the door frame to provide substantially air-tight and water-tight seals, respectively, when the door is closed within the frame. The first and second weatherstripping members are spaced apart so as to define a weatherstripping air space therebetween. The door includes passages for providing communication between the insulating air space and the weatherstripping air space so as to minimize condensation between the glazing panels.

7 Claims, 17 Drawing Figures

DOUBLE OPENING EXTERIOR FRENCH DOOR AND DOOR IMPROVEMENTS

BACKGROUND OF THE INVENTION

This invention relates to door construction, and more particularly, to exterior french doors.

Double opening french doors have long been considered a gracious or otherwise desirable element of home construction. However, french doors have long been impractical for homes in northern climates, because of the high heat losses and drafts caused by the extensive surrounding gaps between such doors and their frames. French doors have been especially disfavored since the energy crisis of the 1970's. While outdoor living spaces such as decks and patios have been increasingly emphasized, the convention has been to provide sliding glass doors, rather than french doors, between home interiors and such exterior living spaces. Despite a recent resurgence in interest in french doors, the northern home dweller has generally faced a choice between a sliding glass door and a look-alike, single opening french door. Double opening french doors have remained an energy-consuming extravegance.

SUMMARY OF THE INVENTION

Given the background of the invention, the object of the inventors in making this invention has been to satisfy the long-standing desire for double opening french doors, with a french door assembly which is energy efficient, and also easily maintained and pleasing in appearance.

Another object has been to provide a french door assembly as described, which is highly adaptable to varying rough openings, for use in home rehabilitation; easily installed for superior operation despite possible installation errors; virtually maintenance free; and pleasing of appearance.

In a principal aspect, then, the invention is a double opening french door assembly. A door frame of the assembly includes a sill, a head and jambs. The head and jambs have wood cores and exterior aluminum cladding. A pair of door panels are each hingedly mounted on a door jamb, and each including stiles, rails and double glazing panels mounted on the stiles and rails. The stiles and rails have wood cores and exterior aluminum cladding. The double glazing panels define an insulating, glazing panel air space therebetween. The aluminum cladding is lanced with lances, and the stiles define air passages from the glazing panel air spaces to the lances.

Interior, air seal weatherstripping is on the jambs and head of the door frame, and on an astragal attached to one of the door panels between the astragal and other door panel. The weatherstripping is located to contact the aluminum cladding on the door frames interior to the lances. The assembly also includes exterior, water seal weatherstripping and exterior weatherstripping retainers. The retainers are mounted to the jambs and head of the door frame and to the astragal between the astragal and door panel. The retainers have two adjacent, alternate weatherstripping kerfs for receiving the exterior, water seal weatherstripping. The exterior, water seal weatherstripping is placed in the kerfs to the exterior of the air seal weatherstripping to contact the aluminum cladding on the door frames exterior to the lances.

The water seal and air seal weatherstripping together provide therebetween an insulating, weatherstripping air space about the jambs and head of the door frame and between the door panels. The lances and air passages provide weather protected pressure equalization to the glazing panel air spaces.

BRIEF DESCRIPTION OF THE DRAWING

The preferred embodiments of the invention are described in the following detailed description of the preferred embodiments with reference to the accompanying drawing. The drawing includes seventeen figures, as follows.

In the following detailed description, the directional terms "interiorly", "exteriorly", "inwardly" and "outwardly" are used. The terms "interiorly" and "exteriorly" refer to directions perpendicular to the plane of the door assemblies, as expected. In contrast, the terms "inwardly", "outwardly", and the like refer to directions in the plane of the door assemblies, toward and away from the centers of the assemblies.

DETAILED DESCRIPTION OF THE PREFERRED EMBODIMENTS

Figure 16:
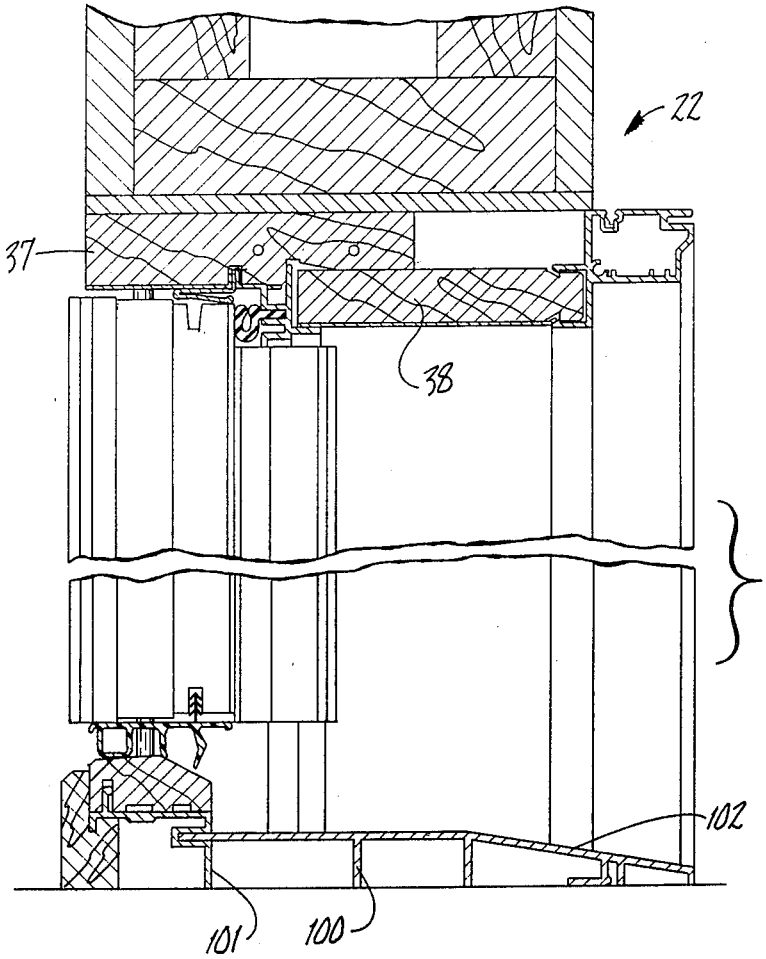
FIG. 16 is a collapsed, cross-sectional view similar to FIG. 7, depicting further the frame width adjustability of the preferred french door assembly, with an adjustable sill.

Referring to FIGS. 1–7, 8–10, 11–15 and 16 as groups, the preferred embodiments of the invention are a first double opening french door assembly 20 (FIGS. 1–7), a single opening french door assembly 30 (FIGS. 8–10), a single door assembly 40 (FIGS. 11–15), and a second double opening french door assembly 22 (FIG. 16). The most preferred assembly is the assembly 20.

Figure 1:
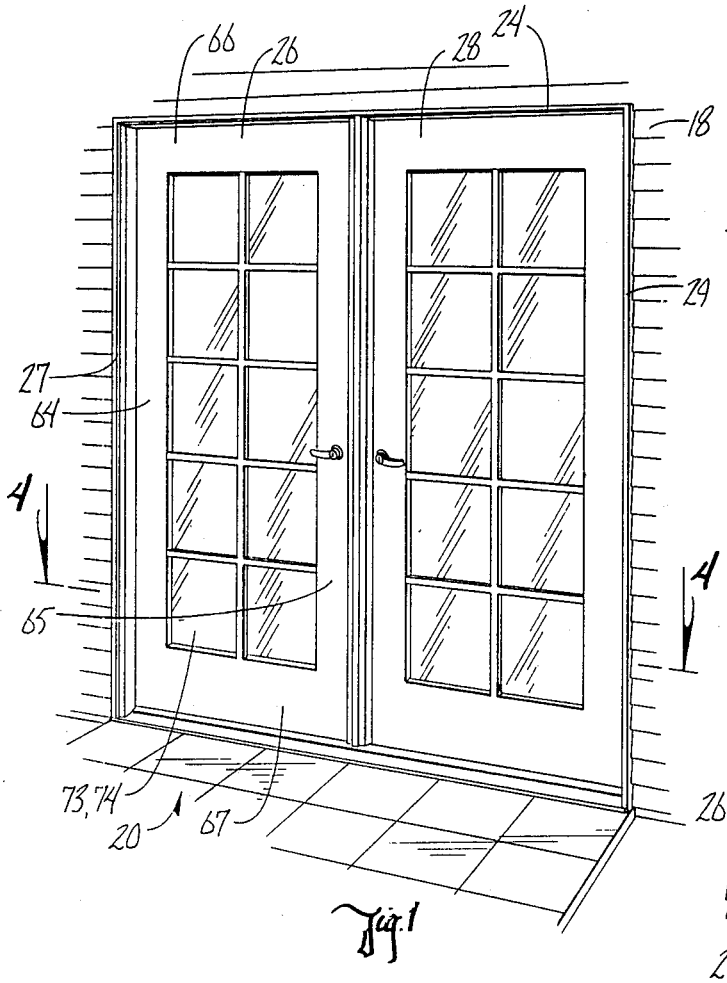
FIG. 1 is an exterior, perspective view of the preferred french door assembly of the invention, adapted for double opening doors hinged at the jambs.
Figure 2:
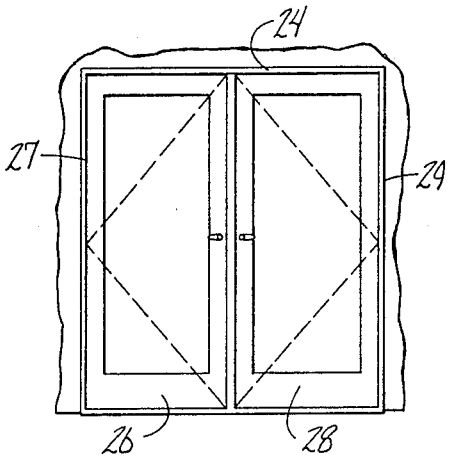
FIG. 2 is a diagrammatic, exterior, elevational view of the preferred french door assembly of FIG. 1.
Figure 3:
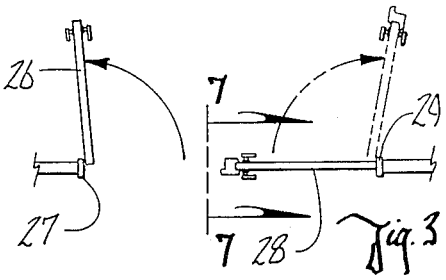
FIG. 3 is a diagrammatic plan view of the door assembly of FIG. 1, showing its manner of opening.

Referring to FIG. 1, the assembly 20 includes a french door frame 24 and two swinging french door panels 26, 28. As shown in FIG. 3, the french door panels 26, 28 swing from opposite door frame jambs 27, 29, respectively, of the door frame 24. As diagrammed in FIG. 2, the panels 26, 28 are hingedly mounted to their jambs 27, 29. The panels swing to the interior, between a door frame head and sill.

The assembly 20 is mounted within a rough opening in a building exterior wall 18, as in FIG. 1. As shown best in FIGS. 4 and 7, the rough opening is defined by wall framing members such as wall studs 32, 33 and a wall header 31. Wall shims 34 are behind the door frame jambs 27, 29, at the locations of the door hinges, such as hinges 35 (three hinges are employed per door panel). These shims help support and straighten the jambs 27, 29. Fasteners such as screws 36 extend through the jambs and wall shims into the wall studs.

The frame jambs 27, 29 each include a plurality of jamb components. As shown best in FIG. 5, each jamb such as jamb 29 includes an interior jamb member 37 through which the screws 36 are driven. The members 37 are wood, and extend interiorly of the wall 18 to provide a nailing surface for door frame trim (not shown). The members 37 also provide hinge locations for the door hinges. The members 37 are not clad.

An exterior frame jamb member 38 is mounted to each interior frame jamb member, within the door opening area and exterior to the door panels. The members 38 are wood, and aluminum clad.

An extruded aluminum jamb frame cover 29 includes an exterior box trim segment 42, and a pair of jamb cover snap flanges 43, 44. The box trim segment 42 overlies the exterior face of the interior jamb member 37, to protect the face and provide decorative exterior detail to the door frame 24. A recess 45 of the segment 42 faces outwardly of the door opening and receives a leg of an aluminum cladding flange 46. The flange 46 extends outward of the segment 42 along the wall 18, providing a trim edge for aluminum siding (not shown) on the wall 18.

The jamb cover snap flanges 43, 44 extend parallel to each other, and are spaced a distance apart equal to the width of the exterior jamb member 38. The outermost flange 44 is along the inner edge of the box trim segment 42. Each snap flange includes a barb 47, and is resilient. The flanges 43, 44 are snapped upon the exterior ends of the exterior jamb members 38, with the barbs in opposed slots 48 within the exterior jamb members 38.

An aluminum jamb cladding strip 49 is also retained within the innermost slots 48 by the barb 47 of the innermost snap flange 43. The cladding strip 49 clads the inner side of the exterior jamb member 38. At the interior end of the jamb member 38, an exterior weatherstripping retainer 50 also holds the strip 49 to the jamb member 38.

The retainer 50 extends from its strip holding end 51 around the inner, interior corner of the jamb member 38. At the corner, the retainer 50 includes two adjacent, parallel kerfs 52, 53. The kerfs 52, 53 open interiorly, toward the adjacent door panel. An exterior, water seal weatherstripping 54, to be described, is received in the kerfs.

Adjacent the kerfs 52, 53, the retainer 50 further includes an interior jamb snap flange 55. The flange 55 and a spaced retainer leg 56 of the retainer 50 enter slits 57, 58 respectively, in the interior jamb member 37, to resiliently fasten the retainer 50 to the door jamb.

Figure 5:
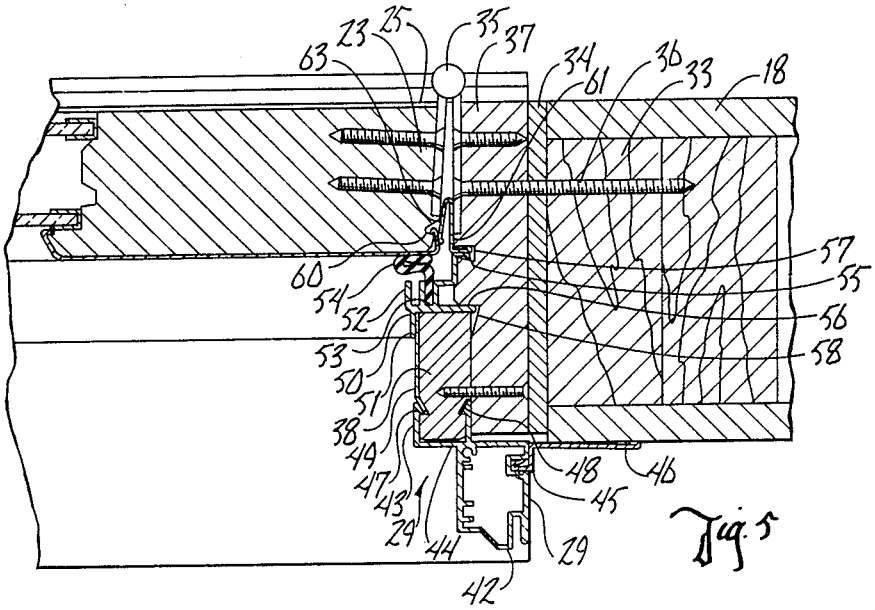
FIG. 5 is a detail view of the door assembly of FIG. 1, taken in the area of circle 5 in FIG. 4.
Figure 7:
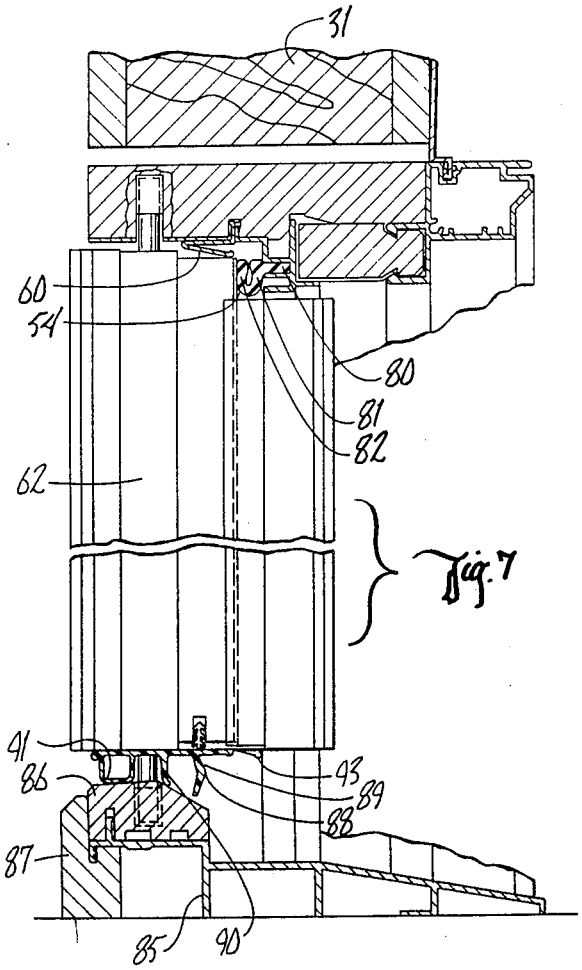
FIG. 7 is a collapsed, cross-sectional view of the door assembly of FIG. 1, taken along line 7—7 of FIG. 3, depicting the frame width adjustability of the frame.
Figure 6:
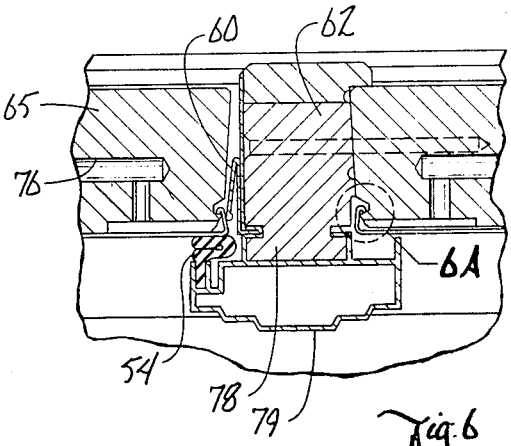
FIG. 6 is a detail view of the door assembly of FIG. 1, taken in the area of circle 6 in FIG. 4.

An interior, air seal weatherstripping 60 also enters the interiormost slit 57 of the retainer slits 57, 58. As shown in FIGS. 5, 6 and 7, the interior weatherstripping 60 extends fully about the jambs and head of the door frame 24, and between the door panels 26, 28. As shown in FIG. 7, the frame head includes interior and exterior head members, a head frame cover, a cladding strip and a weatherstripping retainer identical in cross-section to the corresponding jamb frame members. Thus, on the frame head, the interior weatherstripping 60 enters an interior retainer slit, as on the jambs. Between the door panels 26, 28, the weatherstripping 60 enters a slit on a door center post or astragal 62, as in FIG. 6.

Referring again to FIG. 5, the weatherstripping 60 is a leaf stripping, having a first or backing strip 61 and an angled, door contacting strip 63. The juncture of the strips 61, 63 faces interiorly, and the strips are flexibly movable relative to each other. As most preferred, the weatherstripping 60 is formed of polypropolene. Closure of the door panels 26, 28 flexes the strip 63 toward the strip 61, which causes the strip 63 to resiliently press against the edge of the door panels.

Figure 4:
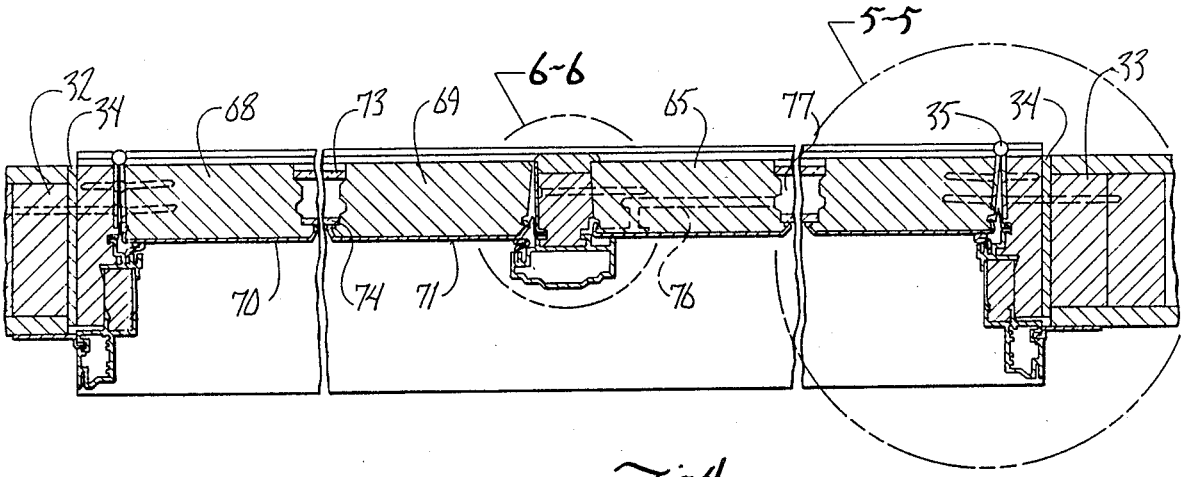
FIG. 4 is a cross-sectional view of the door assembly of FIG. 1, taken along line 4—4 of FIG. 1.

Referring again to FIG. 1, each door panel 26, 28 includes upright stiles 64, 65 and horizontal rails 66, 67, which are jointed to the stiles at the ends. As shown in FIG. 4, by example, the stiles and rails all have wood cores, such as stile cores 68, 69 and are clad by aluminum cladding such as stile cladding 70, 71. The cladding extends across the exterior faces of the stiles and rails and is curved about the edges of the stiles and rails. As shown best in FIG. 6A, the cladding is retained against the wood cores by cladding edge flanges snapped into slits in the stiles and rails, and by adhesive (not shown). Returning to FIG. 4, the stiles and rails provide exposed wood on their interior faces, for pleasing interior appearance.

Door panel hinge leafs 25 of the hinges 35 are screwed to the door panels 26, 28 in routed recesses. As shown in FIG. 5, the leafs are substantially flush with the door. Behind the leafs and in the recesses are hinge shims 23. The hinge shims, leafs and recesses are substantially identical in shape such that the shims and leafs are snug fit in the recesses. The shims are removable. On installation, and after periods of settling or wall warping, the positions of the door panels relative to the door frame may be adjusted by the addition or removal of one or more shims.

The door panels 26, 28 each include double glazing panels 73, 74. Glass is the preferred material of the panels 73, 74, as conventional, and the glazing panels 73, 74 provide between themselves an insulating dead air space in the door panels. The glazing panels are held on the door panels by abutment against the stiles and rails, and by wood retainer strips (not shown) fastened to the stiles and rails.

Figure 6A:
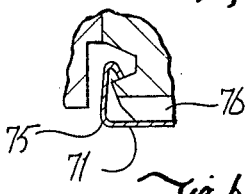
FIG. 6A is a detail view of the door panel aluminum cladding, taken in the area of circle 6A in FIG. 6.

Turning to FIGS. 4, 6 and 6A, each stile and its cladding include pressure equalizing passages for the insulating space between the door glazing panels 73, 74. As shown by example in FIGS. 4 and 6, a stile 65 includes three passages, such as passage 76, which extend from the insulating air space 77. The passages terminate behind the aluminum cladding 71, where lanced openings, or lances, such as 75, provide for communication of the passages outside the door panels.

The lances are located in zones protected against moisture entrance due to weather. The lances on the stile of the door panel to which the astragal is nailed are adjacent the wood astragal core 78, and behind the aluminum astragal cladding 79. The lances elsewhere are exterior to the interior weatherstripping 60, which is located to contact the stile aluminum cladding, and interior to the exterior weatherstripping 54, in the dry, insulating, dead air space provided therebetween.

The passages 76 protect the air spaces between the glazing panels from suffering a pressure difference from the door exterior. At the same time, condensation between the glazing panels is minimized.

As implied, the exterior, water seal weatherstripping 54 extends fully about the door frame and between the door panels, exterior to the air seal weatherstripping 60. The exterior weatherstripping 54 is most preferably polyethylene-covered urethane foam. The exterior weatherstripping has, as in FIG. 7, a retained leg 80 and two resiliently scissoring strips 81, 82.

Referring to FIG. 7, a frame sill 85 completes the door frame 24. The sill 85 is aluminum extruded, and includes a wood threshold 86. Both the threshold 86 and sill 85 are supported atop a wood threshold support 87. The wood threshold 86 and threshold support 87 provide a thermal barrier between the aluminum sill 85 and the door interior.

The bottom of the door panels 26, 28 include a dual durometer vinyl weatherstrip 88. The strip 88 has two exterior flex legs 89, 90 and an interior flex bulb 91 to air seal the bottom of the door panel.

Figure 14:
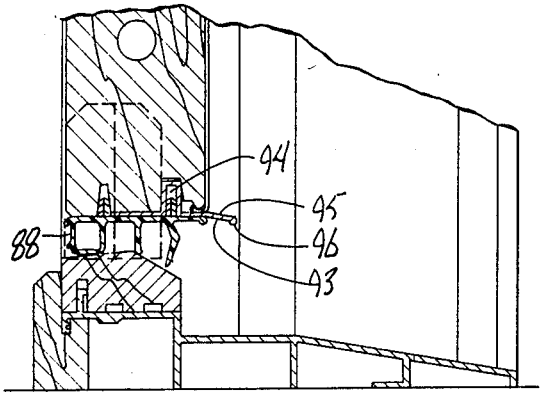
FIG. 14 is a cross-sectional view of the foot of the door of FIG. 12.
Figure 15:
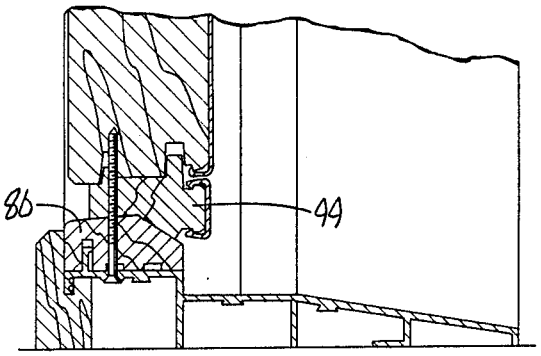
FIG. 15 is a cross-sectional view of the foot of the door of FIG. 13.

As shown partially hidden in FIG. 7 and best shown in FIG. 14, the door panel bottoms further include a rain drip guide 93 along the door panel exterior at the bottom edge. The drip guide is fitted with the weatherstrip 88 into a slot 94 in the door bottom. A projection 95 of the drip guide 93 projects outward from the exterior of the door panel, to a bead 96 remote from the door panel. The drip bead 96 aids beading of rain running down the door panel onto the guide. The drip guide thus keeps dripping water from the weaterstrip 88 and the wood threshold 86.

The preferred embodiment of the invention is now described in detail.

Figure 8:
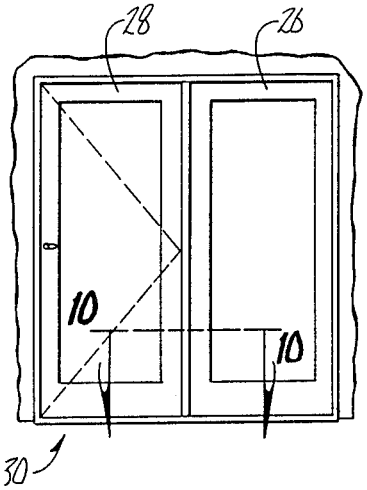
FIG. 8 is a second diagrammatic, elevational view of the preferred door assembly, adapted for a single opening door hinged at the jamb.
Figure 9:
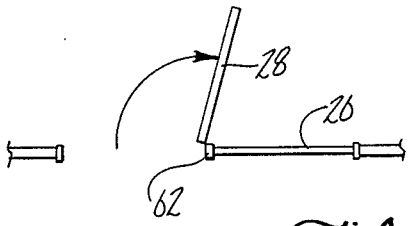
FIG. 9 is a diagrammatic plan view of the door assembly of FIG. 8, depicting the manner of operation.
Figure 10:
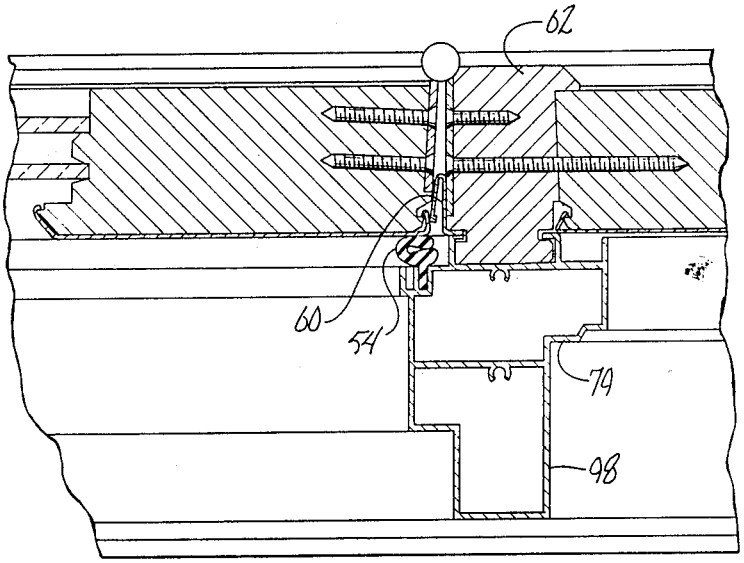
FIG. 10 is a partial, cross-sectional view of the door assembly of FIG. 8, taken along line 10—10 of FIG. 8.
Figure 11:
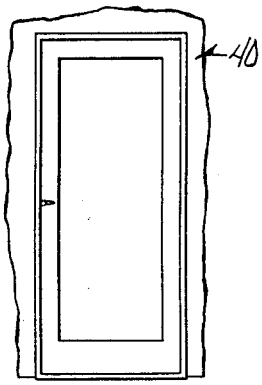
FIG. 11 is a diagrammatic, exterior elevational view of the preferred door assembly, adapted for a single, openable or fixed door.
Figure 12:
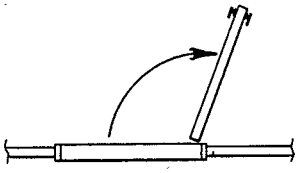
FIG. 12 is a diagrammatic plan view of the door of FIG. 11, as adapted to be openable.
Figure 13:
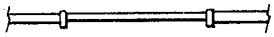
FIG. 13 is a diagrammatic plan view of the door of FIG. 11, adapted to be fixed.

The remaining embodiments include the features of the preferred embodiment, with some modifications. The assembly of FIGS. 8–10 is modified in that the door panel 28 is fixed to the frame 24, and the panel 26 is hinged to the astragal. A second, exteriorly extended astragal cover 98 is attached to the cover 79. The sill is extended, as will be described in relation to FIG. 16.

The assembly 40 of FIGS. 11–15 has one door panel only. The panel may be openable, as in FIGS. 12 and 14, or fixed, as in FIGS. 13 and 15. Where the panel is to be fixed, the bottom weatherstrip 88 is replaced by an aluminum clad, wood core, door rest 99, as in FIG. 15. The sill threshold 86, rest 99 and door panel are screwed together.

The assembly of FIGS. 1–7 is intended for wall thicknesses of four and one half inches to four and three-quarter inches. The assembly of FIG. 16 is for wall thicknesses from four and one half inches to seven inches. The assembly of FIG. 16 includes an extended sill 100, a second astragal cover, and substantially widened exterior frame members. The exterior frame members are positioned relative to the interior frame members in relation to the thickness of the wall to which the door is to be attached. The exterior frame members are then fastened in proper position. For narrower wall thicknesses, the exterior frame members are ripped to fit. The extended sill 100 includes a slotted inner sill member 101 and a flanged outer sill member 102. The flanged outer sill member 102 is also ripped in relation to wall thickness and then fitted to the inner sill member 101.

The preferred embodiments and the invention are now described in such full, clear, concise and exact terms as to enable a person of ordinary skill in the art to make and use the same. As suggested above and otherwise, modifications may be made to the preferred embodiment without moving outside the scope of the invention. Therefore, to particularly point out and distinctly claim the subject matter regarded as invention, the following claims conclude this specification.

What is claimed is:

1. An exterior door assembly comprising:

a door frame including a sill, head and jambs;

a door panel including stiles, rails, and aluminum cladding on the stiles and rails, the door panel being hingedly mounted to a jamb of the door frame;

interior, air seal weatherstripping on the jambs and head of the door frame located to contact the aluminum cladding on the door panel; and exterior, water seal weatherstriping on the jambs and head of the door frame to the exterior of the interior, air seal weatherstriping and also located to contact the aluminum cladding on the panel;

the exterior, water seal and interior, air seal weatherstripping together providing therebetween an insulating, weatherstriping air space about the jambs and head of the door frame;

the door panel further including double glazing panels defining an insulating, glazing panel air space therebetween, the double glazing panels being mounted on the stiles and rails;

the aluminum cladding on the stiles being pierced with lances between the interior, air seal weatherstripping and the exterior, water seal weatherstripping; and the stile defining air passages from the glazing panel air space to the lances.

2. An exterior door assembly as in claim 1 further comprising an exterior weatherstripping retainer mounted to the door frame jambs and head, the retainer having two adjacent, alternate weatherstripping kerfs for receiving the exterior, water seal weatherstripping and the exterior, water seal weatherstripping being placed in the kerfs.

3. An exterior, double opening french door assembly, comprising:

a door frame including a sill, head and jambs, the head and jambs having wood cores and exterior aluminum cladding;

a pair of door panels each hingedly mounted on a door jamb, and each including stiles, rails and double glazing panels mounted on the stiles and rails, the stiles and rails having wood cores and exterior aluminum cladding, the double glazing panels defining an insulating, glazing panel air space therebetween, the aluminum cladding being pierced with lances, and the stiles defining air passages from the glazing panel air spaces to the lances;

interior, air seal weatherstripping on the jambs and head of the door frame and on a stile of one of the door panels between the door panels, the weatherstripping located to contact the aluminum cladding on the door frames interior to the lances;

exterior, water seal weatherstripping and exterior weatherstripping retainers, the retainers mounted to the jambs and head of the door frame and to a stile of one of the door panels between the door panels, the retainers having two adjacent, alternate weatherstripping kerfs for receiving the exterior, water seal weatherstripping, the exterior, water seal weatherstripping being placed in the kerfs to the exterior of the air seal weatherstripping to contact the aluminum cladding on the door frames exterior to the lances;

the water seal and air seal weatherstripping together providing therebetween an insulating, weatherstripping air space about the jambs and head of the door frame and between the door panels.

4. A door assembly, comprising:

a door frame including a sill, a head and opposite jambs;

a door having interior and exterior sides and being hingedly mounted on one of said jambs of said door frame and including stiles, rails, and spaced apart glazing panels mounted within the stiles and rails so as to define an insulating air space therebetween:

first weatherstripping means cooperating with said door and said jambs of said door frame for providing a substantially air-tight seal therebetween when said door is closed within said door frame;

second weatherstripping means cooperating with said door and said jambs of said door frame for providing a substantially water-tight seal therebetween when said door is closed within said door frame;

said second weatherstripping means being positioned exteriorally of said first weatherstripping means so as to define a weatherstripping air space therebetween; and said door having at least one passage therein providing communication between said insulating air space and said weatherstripping air space.

5. The door assembly of claim 4 wherein said passage terminates in a first end adjacent said insulating air space and a second end adjacent said weatherstripping air space and wherein said stiles and rails have exterior cladding, said cladding being in covering relation over said second end of said passage, said cladding is lanced adjacent said second end of said passage.

6. The door assembly of claim 4 wherein said first and second weatherstripping means are mounted on said jambs of said door frame so as to sealingly engage said door when said door is closed within said door frame.

7. The door assembly of claim 4 wherein said seal between said second weatherstripping member and said door and said jambs of said door frame is non-air-tight.

* * * * *